US009221529B1

(12) United States Patent
Schmidt et al.

(10) Patent No.: US 9,221,529 B1
(45) Date of Patent: Dec. 29, 2015

(54) LIFE JACKET WITH A LOCK

(71) Applicants: David Schmidt, Buffalo, MN (US); Douglas Schmidt, Buffalo, MN (US)

(72) Inventors: David Schmidt, Buffalo, MN (US); Douglas Schmidt, Buffalo, MN (US)

( * ) Notice: Subject to any disclaimer, the term of this patent is extended or adjusted under 35 U.S.C. 154(b) by 0 days.

(21) Appl. No.: 14/687,048

(22) Filed: Apr. 15, 2015

(51) Int. Cl.

| | |
|---|---|
| ***B63C 9/11*** | (2006.01) |
| ***E05B 65/00*** | (2006.01) |
| ***E05B 67/06*** | (2006.01) |
| ***E05B 67/08*** | (2006.01) |

(52) U.S. Cl.
CPC . *B63C 9/11* (2013.01); *E05B 65/00* (2013.01); *E05B 67/063* (2013.01); *E05B 67/08* (2013.01)

(58) Field of Classification Search
CPC ..... B63C 9/11
See application file for complete search history.

(56) References Cited

U.S. PATENT DOCUMENTS

| | | | | |
|---|---|---|---|---|
| 4,819,988 | A | 4/1989 | Hellstrom | |
| 5,774,956 | A * | 7/1998 | French | A44B 11/263 24/616 |
| 6,431,652 | B1 | 8/2002 | Kennedy | |
| 6,938,925 | B2 | 9/2005 | Mather | |
| 7,415,850 | B2 * | 8/2008 | Smyczek | E05B 37/14 70/20 |
| 7,895,719 | B2 * | 3/2011 | Woods | A01K 27/005 24/615 |
| 2005/0055810 | A1 * | 3/2005 | Loughlin | A44B 11/266 24/615 |

* cited by examiner

*Primary Examiner* — Edwin Swinehart
(74) *Attorney, Agent, or Firm* — Crossley Patent Law

(57) ABSTRACT

A life jacket with a lock including a life jacket having at least one belt in combination with a releasable buckle, the releasable buckle having a female member and a male member. Each of the female member and the male member has a top side and a bottom side. An opening is continuously disposed through the male member from the top side to the bottom side. An aperture is continuously disposed through the female member from the top side to the bottom side. The opening and the aperture are colinearly disposed when the female member is securely engaged with the male member. A U-lock slidingly engages the opening in combination with the aperture when the female member is securely engaged with the male member.

3 Claims, 6 Drawing Sheets

LIFE JACKET WITH A LOCK

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of life jackets are known in the prior art. However, what has been needed is a life jacket having at least one belt in combination with a releasable buckle, the releasable buckle having a female member and a male member. Each of the female member and the male member has a top side and a bottom side. The female member is configured to securely engage the male member. What has been further needed is an opening continuously disposed through the male member from the top side to the bottom side and an aperture continuously disposed through the female member from the top side to the bottom side. Lastly, what has been needed is for a U-lock to slidingly engage the opening in combination with the aperture when the female member is securely engaged with the male member. The U-lock can optionally be a buoyant plastic. The U-lock is thus configured to lock the male member with the female member, which will prevent a child from removing the life vest without adult supervision or consent.

FIELD OF THE INVENTION

The present invention relates to personal flotation devices, and more particularly, to a life jacket with a lock.

SUMMARY OF THE INVENTION

The general purpose of the present life jacket with a lock, described subsequently in greater detail, is to provide a life jacket which has many novel features that result in a life jacket with a lock which is not anticipated, rendered obvious, suggested, or even implied by prior art, either alone or in combination thereof.

To accomplish this, the present life jacket with a lock comprises a life jacket having at least one belt in combination with a releasable buckle. The releasable buckle has a female member and a male member. Each of the female member and the male member has a top side and a bottom side. The female member is configured to securely engage the male member. An opening is continuously disposed through the male member from the top side to the bottom side. An aperture is continuously disposed through the female member from the top side to the bottom side. The opening and the aperture are colinearly disposed when the female member is securely engaged with the male member. The life jacket with a lock further comprises a U-lock. The U-lock comprises a crossbar and a locking portion. The locking portion has a pair of ends. The crossbar is configured to detach and, alternately, remain attached to one of the pair of ends when the U-lock is in an open position. The U-lock slidingly engages the opening in combination with the aperture when the female member is securely engaged with the male member. The U-lock is optionally a buoyant plastic. The U-lock is configured to lock the male member with the female member.

Thus has been broadly outlined the more important features of the present life jacket with a lock so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 6 thereof, an example of the instant life jacket with a lock employing the principles and concepts of the present life jacket with a lock and generally designated by the reference number 10 will be described.

Figure 1:
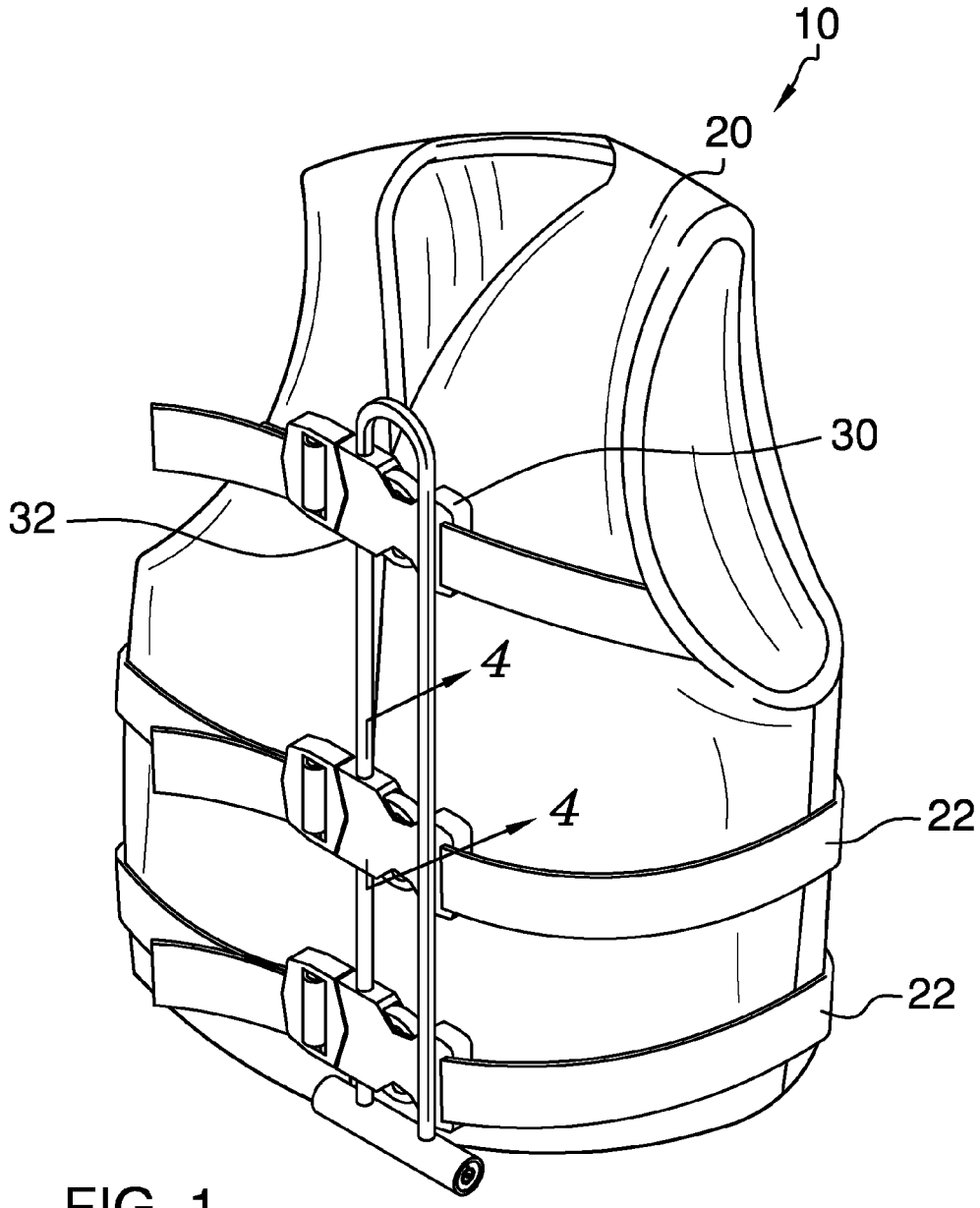
FIG. 1 is a front isometric view view.
Figure 2:
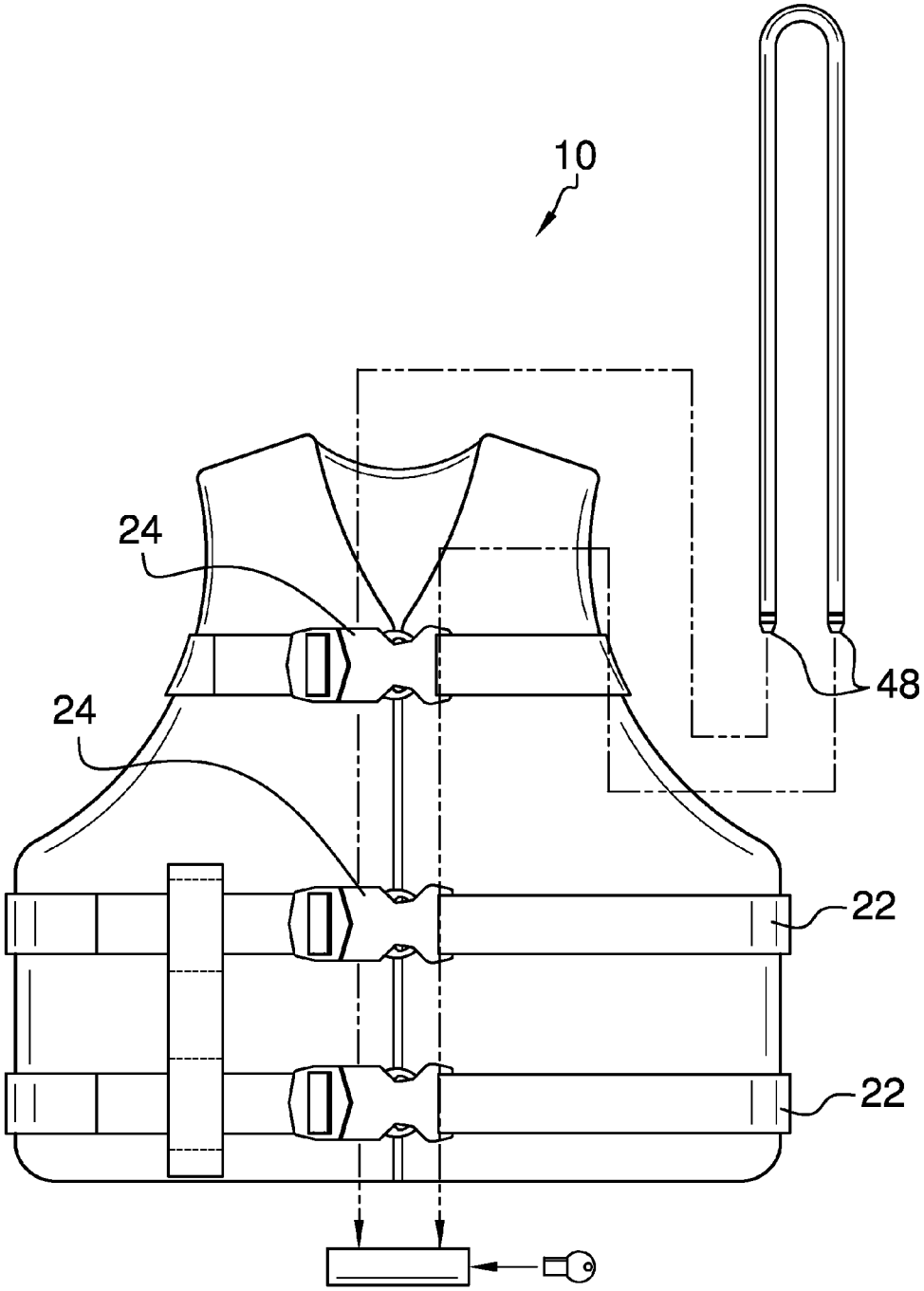
FIG. 2 is an exploded view showing a crossbar detached from a locking portion of a U-lock.
Figure 3:
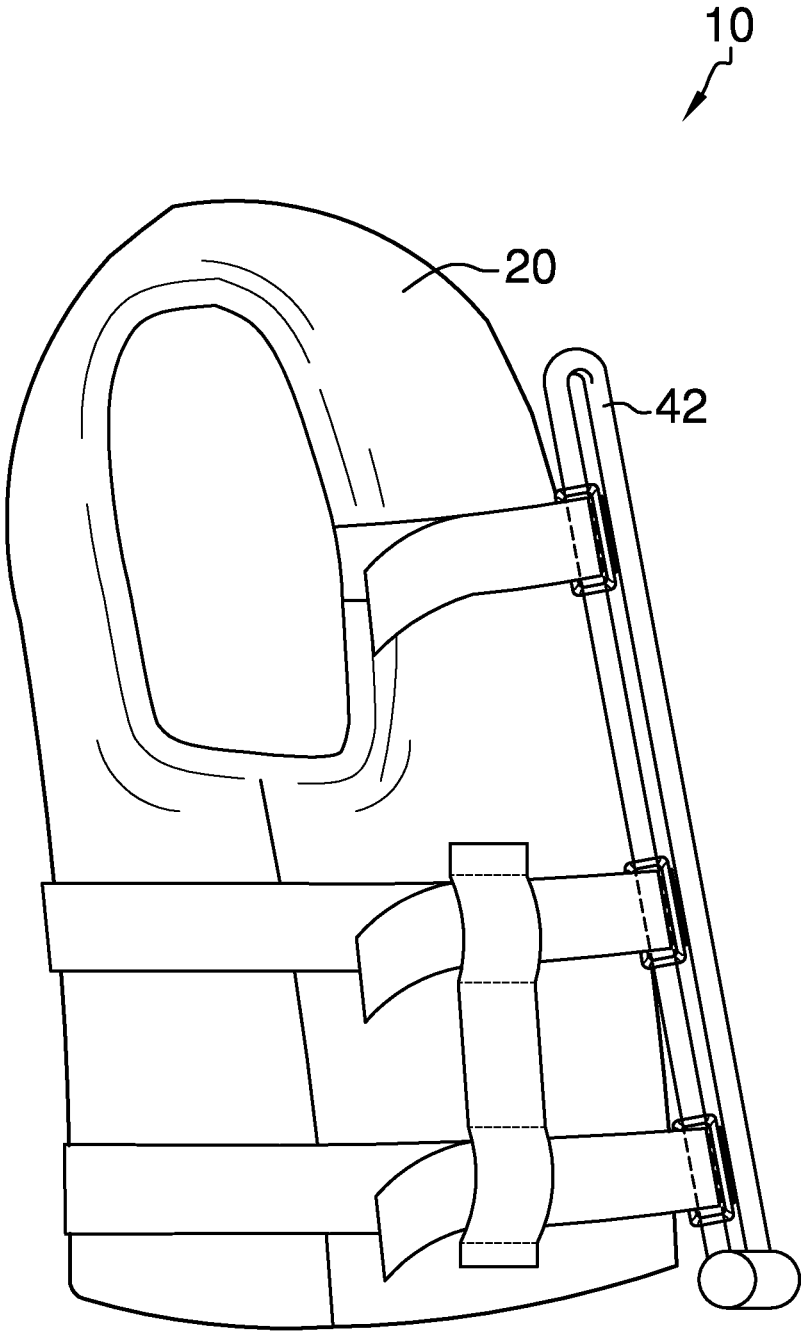
FIG. 3 is a side elevation view.
Figure 4:
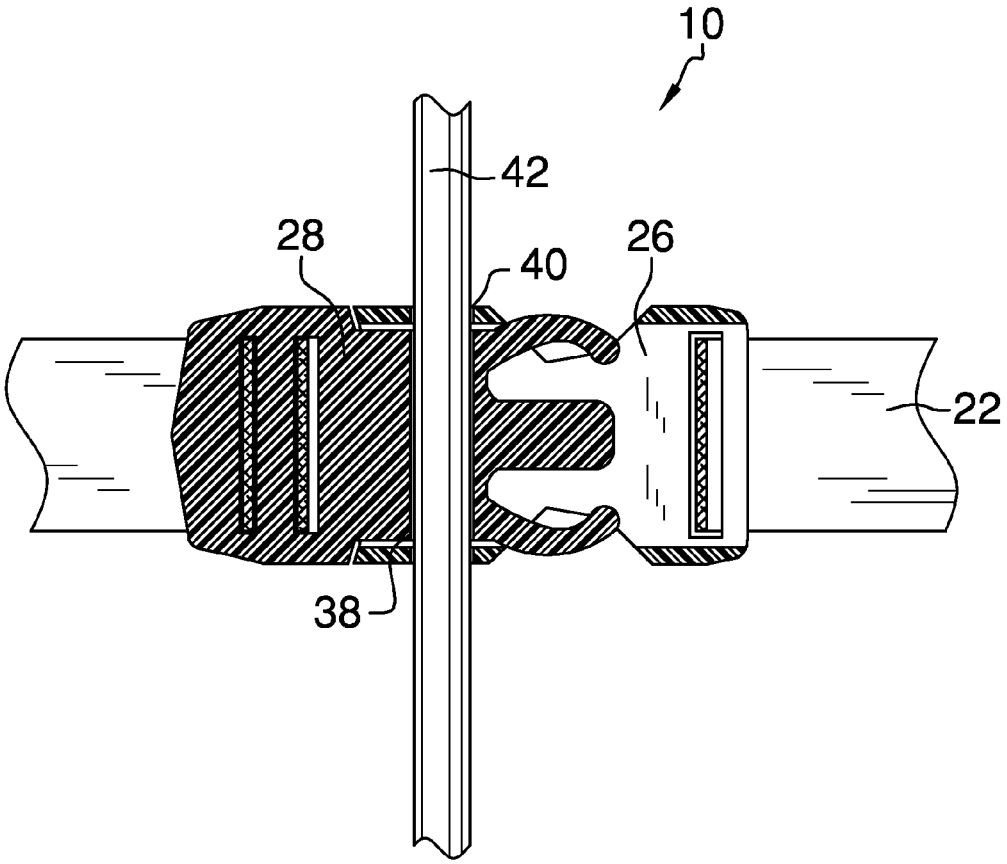
FIG. 4 is a cross-sectional view along line 4-4 of FIG. 1.
Figure 5:
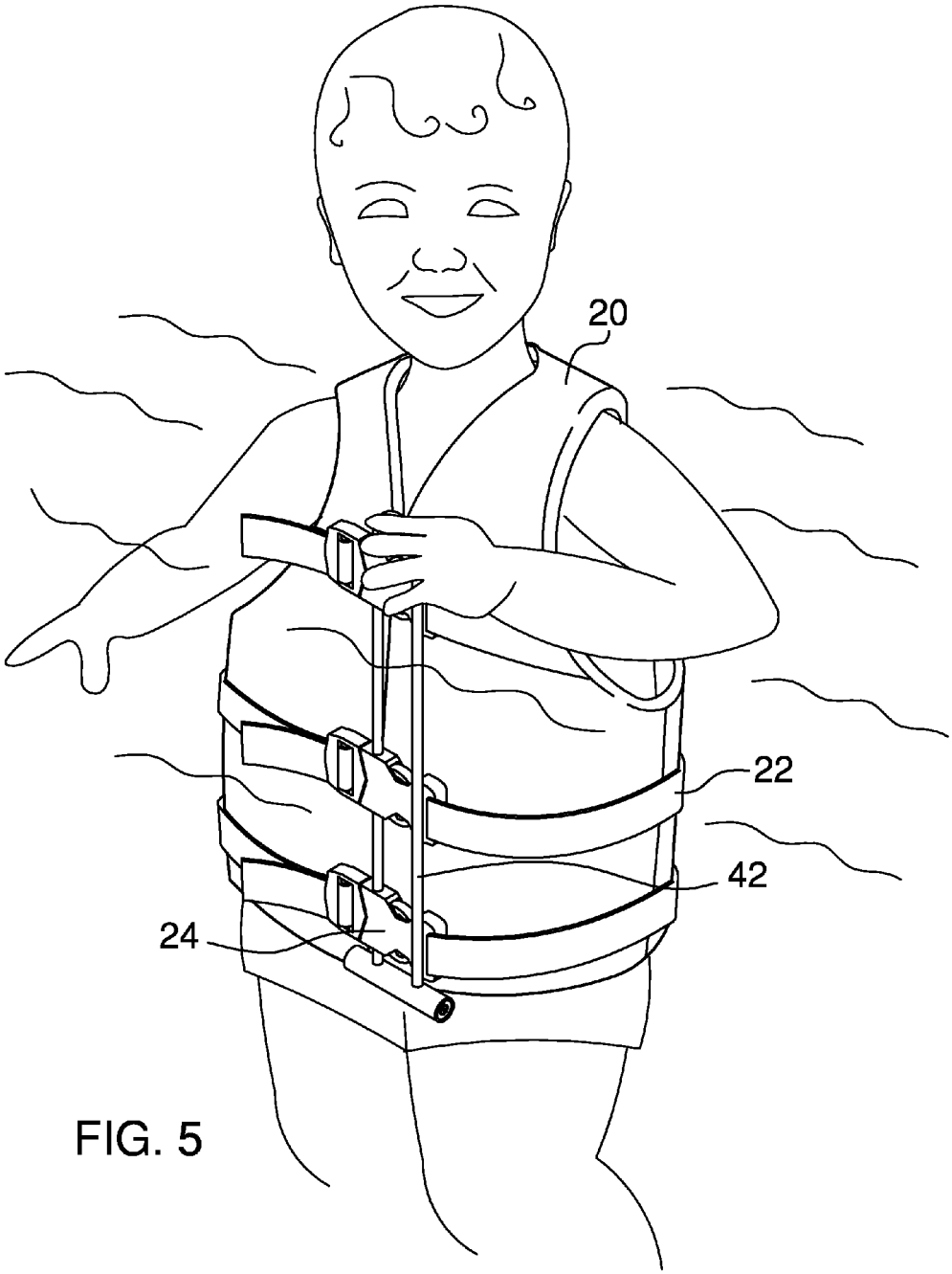
FIG. 5 is an in-use view.
Figure 6:
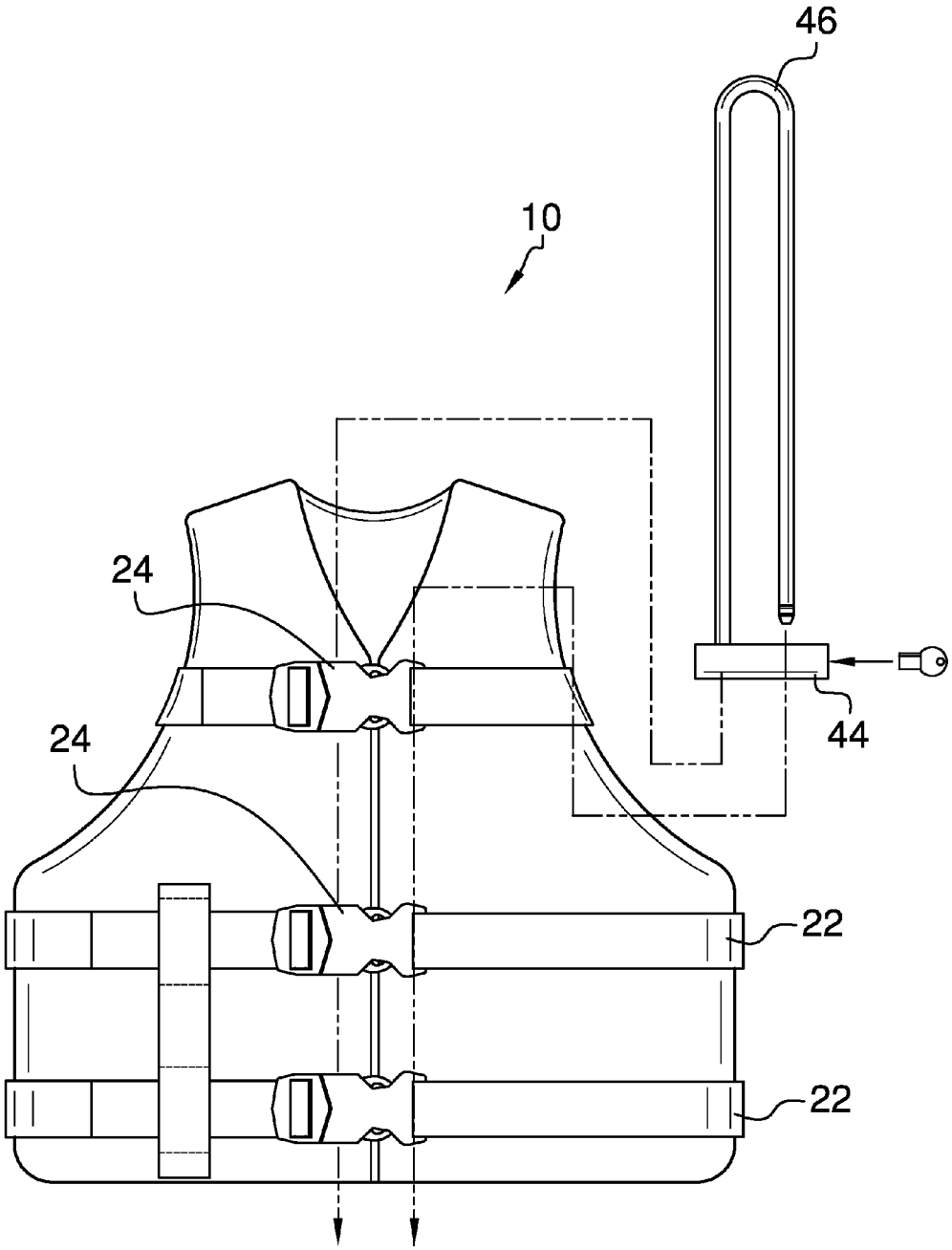
FIG. 6 is an exploded view showing the crossbar attached to one of a pair of ends on the locking portion of the U-lock.

Referring to FIGS. 1 through 6, the present life jacket with a lock 10 is illustrated. The life jacket with a lock 10 comprises a life jacket 20 having at least one belt 22 in combination with a releasable buckle 24. The releasable buckle 24 has a female member 26 and a male member 28. Each of the female member 26 and the male member 28 has a top side 30 and a bottom side 32. As best shown in FIG. 4, the female member 26 is configured to securely engage the male member 28. An opening 38 is continuously disposed through the male member 28 from the top side 30 to the bottom side 32. An aperture 40 is continuously disposed through the female member 26 from the top side 30 to the bottom side 32. As best shown in FIG. 4, the opening 38 and the aperture 40 are colinearly disposed when the female member 26 is securely engaged with the male member 28. The life jacket with a lock 10 further comprises a U-lock 42. The U-lock 42 comprises a crossbar 44 and a locking portion 46. The locking portion 46 has a pair of ends 48. As best shown in FIGS. 2 and 7, the crossbar 44 is configured to detach and, alternately, remain attached to one of the pair of ends 48 when the U-lock 42 is in an open position. The U-lock 42 slidingly engages the opening 38 in combination with the aperture 40 when the female member 26 is securely engaged with the male member 28.

What is claimed is:

1. A life jacket with a lock comprising:

a life jacket having at least one belt in combination with a releasable buckle, the releasable buckle having a female member and a male member, each of the female member and the male member having a top side and a bottom side, the female member configured to securely engage the male member;

an opening continuously disposed through the male member from the top side to the bottom side;

an aperture continuously disposed through the female member from the top side to the bottom side;

wherein the opening and the aperture are colinearly disposed when the female member is securely engaged with the male member; and a U-lock comprising a crossbar and a locking portion, the locking portion having a pair of ends;

wherein the crossbar is configured to detach and alternately remain attached to one of the pair of ends when the U-lock is in an open position;

wherein the U-lock slidingly engages the opening in combination with the aperture when the female member is securely engaged with the male member, the U-lock configured to lock the male member with the female member.

2. The life jacket with a lock of claim 1 wherein the U-lock is buoyant.

3. The life jacket with a lock of claim 2 wherein the U-lock is plastic.

* * * * *